US006746321B2

(12) United States Patent
Link

(10) Patent No.: US 6,746,321 B2
(45) Date of Patent: Jun. 8, 2004

(54) ELECTRICAL GRINDING POWER TOOL WITH GRINDING DUST SUCTION

(75) Inventor: Bernhard Link, Altenstadt (DE)

(73) Assignee: Hilti Aktiengesellschaft, Schaan (LI)

( * ) Notice: Subject to any disclaimer, the term of this patent is extended or adjusted under 35 U.S.C. 154(b) by 241 days.

(21) Appl. No.: 09/933,968

(22) Filed: Aug. 21, 2001

(65) Prior Publication Data

US 2002/0028645 A1 Mar. 7, 2002

(30) Foreign Application Priority Data

Aug. 25, 2000 (DE) ..... 100 41 906

(51) Int. Cl.[7] ..... B24B 27/08

(52) U.S. Cl. ..... 451/354; 451/356; 451/344; 451/456

(58) Field of Search ..... 451/354, 356, 451/357, 358, 359, 456

(56) References Cited

U.S. PATENT DOCUMENTS 4,184,291 A * 1/1980 Marton ..... 451/344
4,759,155 A * 7/1988 Shaw ..... 451/524
4,779,385 A * 10/1988 Reiter ..... 451/354
4,937,984 A * 7/1990 Taranto ..... 451/524
5,283,988 A * 2/1994 Brown ..... 451/524
6,027,399 A * 2/2000 Stewart ..... 451/353

FOREIGN PATENT DOCUMENTS

| | | |
|---|---|---|
| DE | 4023464 | 1/1992 |
| GB | 2365807 | 2/2002 |
| SE | 8000352 | 9/1986 |

* cited by examiner

*Primary Examiner*—Timothy V. Eley
(74) *Attorney, Agent, or Firm*—Sidley Austin Brown & Wood, LLP

(57) ABSTRACT

A grinding power tool including a motor-driven grinding plate (2) supported in the housing (1) and having a plurality of suction openings (3) connected by a suction channel (4) provided in the housing (1) with a vacuum source (5), and at least one suction relief valve associated with the suction channel (4) for controlling pressure in the suction channel (4).

3 Claims, 2 Drawing Sheets

1
6
7
9
13
4
2
3
3
3
3
14
11
10
8
5

ELECTRICAL GRINDING POWER TOOL WITH GRINDING DUST SUCTION

BACKGROUND OF THE INVENTION

1. Field of the Invention

The present invention relates to a grinding power tool and, in particular to a hand-guided electrical orbital sander, including a housing, a motor-driven grinding plate supported in the housing and having a plurality of suction openings, and a section channel provided in the housing for connecting the suction openings with a vacuum source.

2. Description of the Prior Air

Grinding power tools and, in particular, electrical grinding power tool with a suction device of the type described above are used when, e.g., unnecessary pollution of the environment and/or contamination of the user are to be avoided. Grinding dust, which is produced during grinding of, e.g., a constructional component, is removed from the constructional component with an air stream through a suction channel. To generate a necessary vacuum, an external vacuum source, in particular, a vacuum cleaner, is used. A further possibility of generating vacuum, consists in using of an internal vacuum source, e.g., a motor-driven ventilator, which is located in the tool housing. When an external vacuum source is used, it is often provided with a filter unit for filtering the grinding dust. When an internal vacuum source is provided in the power tool, the filter unit is provided in form of a filter bag which is releasably secured to the tool housing, in particular, to the suction channel.

An electrical grinding power tool of the type described above is disclosed, e.g., in German Publication DE-A1-195 30 542. The known power tool has a suction channel and, in particular, a suction union, which is provided at the suction channel, to which a filter bag is releasably secured. The suction union is provided at its free end with a valve that closes the suction union as soon as the suction process ends. The known power tool further includes a motor located in the tool housing for driving supported in the housing, grinding plate and ventilator. The ventilator is connected with the suction channel and provides for aspiration of the grinding dust-loaded air through the suction channel and for blowing the grinding dust-loaded air out of the suction channel and into the filter unit. The filter unit, the filter bag, is air-permeable but retains the grinding dust.

The known suction device provides for an adequate suction of the grinding duct without a need in an external vacuum source. Because the filter bag or the like is secured on the suction union, the filter bag can be secured on the suction union or replaced by the user himself.

A drawback of the known electrical grinding power tool consists in that the ventilator is driven by the tool motor and the size of the ventilator is limited by the size of the housing, which limits the suction capacity of the ventilator.

A further drawback consists in that only small filter units, in particular, filter bags may be used in order to insure compactness and, thereby, the handling of the power tool. Moreover, because the user has to often replace or clean the filter bag, loss of time takes place.

A similar grinding power tool is disclosed in U.S. Pat. No. 6,027,399. The grinding power tool of U.S. Pat. No. 6,027,399 is connected with an external dust suction means. In this grinding power tool, the motor-driven grinding plate has a plurality of opening which are closed with pegs. The grinding dust is aspirated directly from the grinding plate by an external vacuum source, e.g., vacuum cleaner, through suction holes provided in the bottom of the grinding plate.

The advantage of the grinding power tool disclosed in U.S. Pat. No. 6,027,399 consists in that the suction capacity can be adapted to the operational or work requirements by using a correspondingly dimensioned vacuum source. In addition, by providing closable openings, deposit of the dust on the constructional component is avoided.

A drawback of the grinding power tool of U.S. Pat. No. 6,027,399 consists in that dependent on the suction capacity of the used vacuum source, the opening in the grinding plate need be closed with pegs.

A further drawback of the grinding power tool of U.S. Pat. No. 6,027,399 consists in that the user should always carry a large number of closing pegs to be able to close the necessary openings. In addition, if no vacuum source is available at the operational site, the suction cannot take place.

Accordingly, an object of the present invention is to provide a compact and easily handled electrical grinding power tool with a suction capability.

A further object of the present invention is to provide an electrical grinding power tool with suction capability with which an adequate suction capacity is always available.

Another object of the present invention consists in providing an electrical grinding power tool with suction capability which can be economically produced.

SUMMARY OF THE INVENTION

These and other objects of the present invention, which will become apparent hereinafter, are achieved by providing a suction relief valve associated with the suction channel for controlling pressure in the suction channel.

The suction relief valve permits to limit the maximum vacuum in the suction channel. Thereby, no deposit of dust takes place on the treated constructional component even when a large capacity vacuum source is used. Further, by providing a suction relief valve at the suction channel, only a little pollution is observed as a result of displacement of the grinding plate, as. e.g., on the grinding plate itself. Thereby, a long service life of the electrical grinding power tool and, in particular, of the suction means is insured.

Advantageously, the suction relief valve is provided at the connection end region of the suction channel in order that a sufficient amount of air is available. In addition, the compactness and ease of handling of the power tool is not affected or affected only minimally. During the manufacturing of the electrical grinding power tool, the assembly of the suction relief valve can be effected without significant costs, which reduces the entire manufacturing costs.

Advantageously, the suction relief valve is arranged in a through-opening provided at the connection end region of the suction channel and has a resilient sealing member which sealingly closes the through-opening during idling of the power tool. Thereby, an easy and simple replacement of the suction relief valve is possible. When the difference between the environmental pressure and the pressure in the suction channel is large, the sealing member is pulled from its rest position, in which it closes through-opening, into the interior of the suction channel against its own biasing force. Thereby, at least partial equalization of pressures takes place.

The sealing member is advantageously secured on the suction channel with a clamp strap, which insures its easy mounting.

In order to insure a sufficiently high resiliency of the sealing member, it is made of a polymer material.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
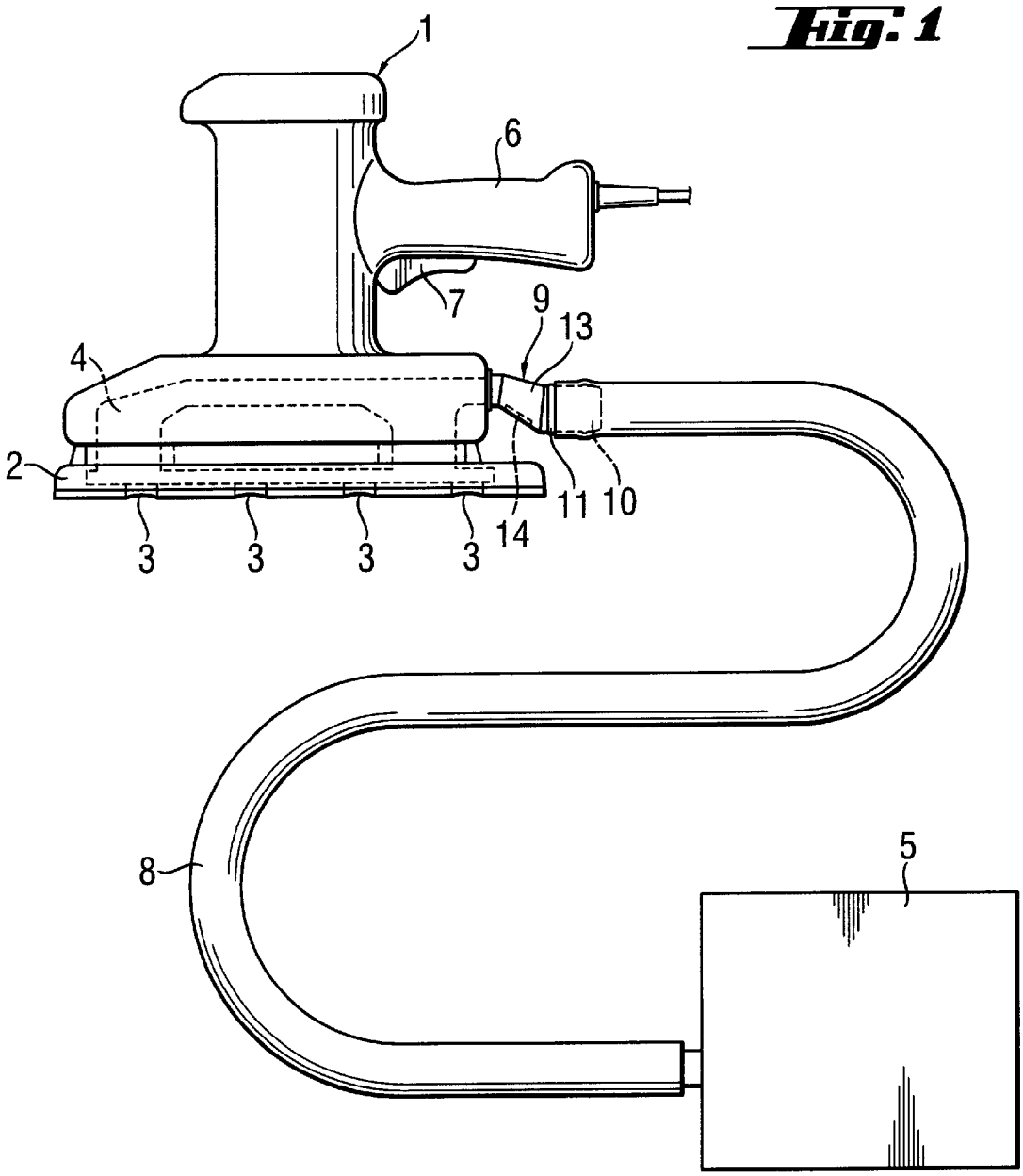
FIG. 1 a side view of an electrical grinding power tool wit grinding dust suction according to the present invention.

An electrical power grinding tool with a suction device according to the present invention, which is generally shown in FIG. 1, included a housing 1 and a motor-driven grinding plate 2 supported in the housing 1. The grinding plate 2 is provided, at its operating side, with a plurality of suction openings 3 for aspirating grinding dust and is connected with a suction channel 4.

The housing 1 has a handle 6 for guiding the electrical grinding power tool. The handle 6 is equipped with a switch 7 for turning the power tool motor on and off.

The suction channel 4 has, at its connection end region 10, a suction union 9 which is connected with an external vacuum source 5 by a flexible hose 8. A vacuum, which is generated in the vacuum source 5, provides for aspiration of a grinding dust-loaded air through the suction holes 3 in the grinding plate 2.

Figure 2:
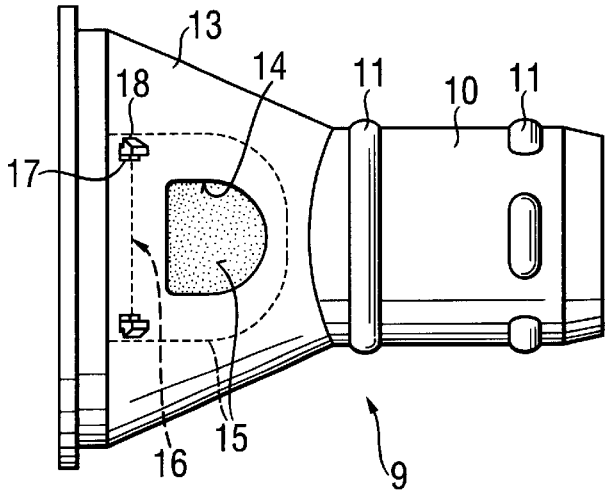
FIG. 2 a bottom view, at an increased, in comparison with FIG. 1, scale, of the connection end region of the suction channel of the power tool according to the present invention.
Figure 3:
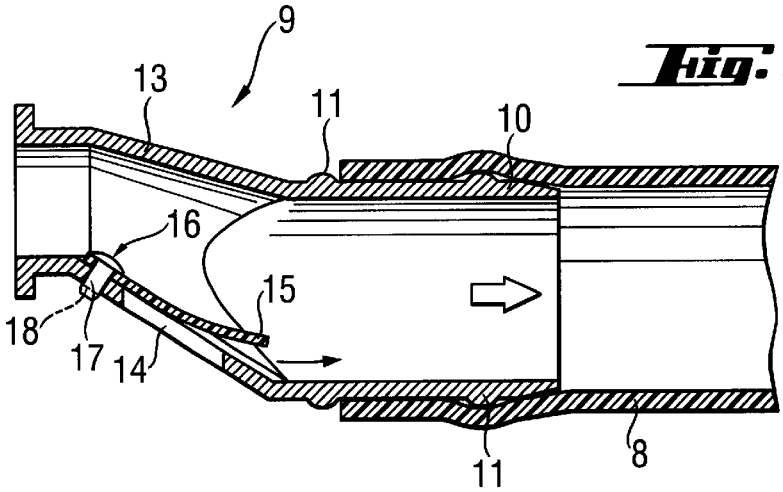
FIG. 3 a cross-sectional view of the connection end region of the suction channel with an open suction relief valve.
Figure 4:
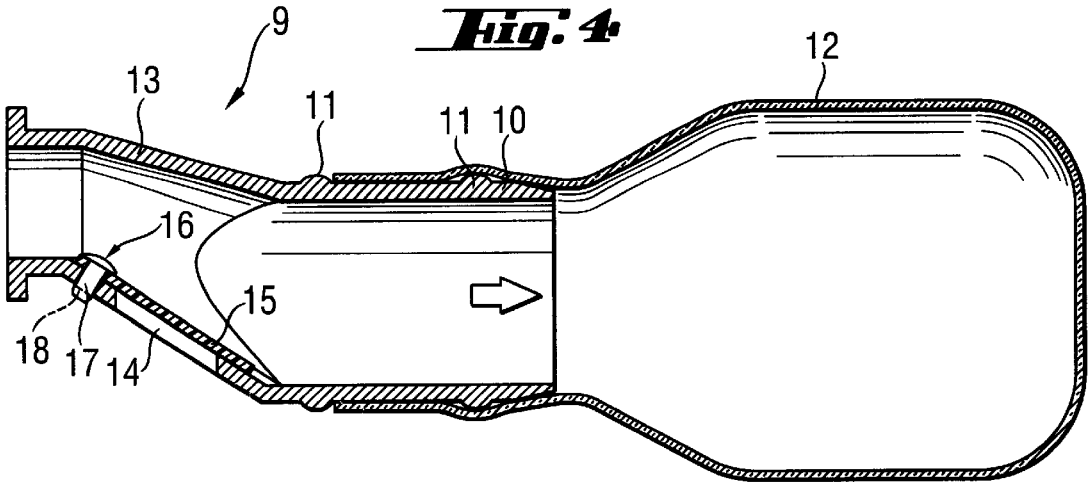
FIG. 4. a cross-sectional view of the connection end region of the suction channel with a closed suction relief valve.

FIGS. 2–4 show tubular suction unions 9 at an increased scale. At its end adjoining the connection end region 10 of the channel 4, the connection union 9 has two circumferential webs 11. The webs 11 provide for releasable connection of the hose 8 with the connection union 9, as shown in FIGS. 1 and 3, and for a releasable connection of a filter bag 12, as shown in FIG. 4.

The connection union 9 is connected with the end region 10 of the suction channel 4 with its connection section 13 the cross-section of which is greater than the cross-section of the connection end region. The wall of the connection section 13 has a through-opening 14 that is closed with a flexible sealing member 15. The sealing member 15 is arranged on the inner surface of the connection section 13 and extends over he through-opening 14. In the idle condition of the power tool, the sealing member 15 closes the through-opening 14 air-tightly. For retaining of the sealing member 15, there is provided a u-shaped resilient clamp 16 that extends through two openings 17 as particularly shown in FIG. 2 at its opposite ends, the clamp strap 16 is provided with two hooks 18, respectively, which engage the wall of the connection section 13 from beneath in the idle position of the power tool.

Upon actuation of the external power source, the vacuum is applied to the suction channel 4 through the hose 8, with the sealing member 15 and the through-opening 14 acting as a suction relief valve. When a predetermined pressure difference between the surrounding air pressure and the pressure in the suction channel is achieved, the sealing member 15 is pulled inward into the interior of the suction union 13 against the internal biasing force of the sealing member 15. A partial opening of the through-opening 14 provides for at least partial equalization between the atmospheric pressure and the pressure in the channel 4. With reduction of the pressure difference between the atmospheric pressure and the pressure in the channel 4, the sealing member 15 moves toward the through-opening 14.

When an internal vacuum source of the power tool, e.g., a motor-driven ventilator, is provided and is operationable during operation of the power tool, the through-opening 14 remains closed by the sealing member 15. Thereby, the grinding dust-loaded air can pass through the connection union 9 without any hindrance and be filtered in the filter bag 12, as it is particularly shown in FIG. 4.

Though the present invention was shown and described with references to the preferred embodiments, such are merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A grinding power tool, comprising a housing (1); a motor-driven grinding plate (2) supported in the housing (1) and having a plurality of suction openings (3); a suction channel (4) provided in the housing (1) for connecting the suction openings (3) with a vacuum source (5); at least one suction relief valve associated with the suction channel (4) for controlling pressure in the suction channel (4); and a connection union (3) arranged at a connection end region (10) of the suction channel (4) for releasably connecting the suction channel (4) with one of a hose (8), which connects the suction channel (4) with the vacuum source (5), and a filter bag (12), wherein the suction relief valve comprises a through-opening (14) formed in the connection union (3) and located outside of the power tool, and a resilient sealing member (15) for sealingly closing the through-opening (14) in an idle position of the power tool, the sealing member (15) being automatically pulled in an interior of the connection union (9) against an internal biasing force of the sealing member (15) when, upon actuation of the vacuum source (5), a predetermined pressure difference between pressure in the suction channel (4) and a surrounding pressure is reached.

2. A grinding power tool according to claim 1, further comprising a clamp strap (16) for securing the resilient sealing member (15) to a wall of the connection union (9) in which the through-opening (14) is formed.

3. A grinding power tool according to claim 1, wherein the sealing member (15) is formed of a polymer material.

* * * * *